US006425816B1

(12) United States Patent
Roberts et al.

(10) Patent No.: US 6,425,816 B1
(45) Date of Patent: Jul. 30, 2002

(54) POLISHING PADS AND METHODS RELATING THERETO

(75) Inventors: John V. H. Roberts; David B. James, both of Newark, DE (US); Lee Melbourne Cook, Steelville, PA (US); Charles W. Jenkins, Greer, SC (US)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/862,734

(22) Filed: May 22, 2001

Related U.S. Application Data

(62) Division of application No. 09/514,717, filed on Feb. 28, 2000, which is a continuation-in-part of application No. 09/465,566, filed on Dec. 17, 1999, now Pat. No. 6,217,434, which is a continuation-in-part of application No. 09/129,301, filed on Aug. 5, 1998, now abandoned, which is a continuation of application No. 09/054,948, filed on Apr. 3, 1998, now Pat. No. 6,022,268.

(60) Provisional application No. 60/054,906, filed on Aug. 6, 1997, provisional application No. 60/043,404, filed on Apr. 4, 1997, and provisional application No. 60/049,440, filed on Jun. 12, 1997.

(51) Int. Cl.[7] ..... B24B 1/00

(52) U.S. Cl. ..... 451/533; 451/41; 451/307; 451/548

(58) Field of Search ..... 451/533, 41, 298, 451/307, 527, 550, 548

(56) References Cited

U.S. PATENT DOCUMENTS

| | | | | |
|---|---|---|---|---|
| 3,889,430 A | | 6/1975 | Scandaletos | |
| 4,927,432 A | | 5/1990 | Budinger et al. | |
| 5,007,207 A | | 4/1991 | Phaal | |
| 5,081,051 A | | 1/1992 | Mattingly et al. | |
| 5,177,908 A | | 1/1993 | Tuttle | |
| 5,189,068 A | | 2/1993 | LaFleur et al. | |
| 5,234,867 A | * | 8/1993 | Schultz et al. | 438/692 |
| 5,247,765 A | | 9/1993 | Quintana | |
| 5,394,655 A | | 3/1995 | Allen et al. | |
| 5,489,233 A | | 2/1996 | Cook et al. | |
| 5,569,062 A | | 10/1996 | Karlsrud | |
| 5,605,760 A | | 2/1997 | Roberts | |
| 5,658,190 A | * | 8/1997 | Wright et al. | 451/285 |
| 5,664,989 A | * | 9/1997 | Nakata et al. | 451/285 |
| 5,997,384 A | | 12/1999 | Blalock | |
| 6,010,395 A | | 1/2000 | Nakajima | |
| 6,022,268 A | | 2/2000 | Roberts et al. | |
| 6,287,185 B1 | * | 9/2001 | Roberts et al. | 451/548 |

* cited by examiner

*Primary Examiner*—Joseph J. Hail, III
*Assistant Examiner*—Anthony Ojini
(74) *Attorney, Agent, or Firm*—Konrad Kaeding; Gerald K. Kita; Kenneth A. Benson

(57) ABSTRACT

Polishing pads are provided having a polishing surface formed from a material. The polishing surface has a topography produced by a thermoforming process. The topography consists of large and small features that facilitate the flow of polishing fluid and facilitate smoothing and planarizing.

28 Claims, No Drawings

POLISHING PADS AND METHODS RELATING THERETO

This application is a division of application Ser. No. 09/514,717 filed Feb. 28, 2000, which is a Continuation-In-Part of Ser. No. 09/129,301 filed Aug. 5, 1998, abandoned which claims the benefit of U.S. Provisional Application No. 60/054,906 filed Aug. 6, 1997, and which is a Continuation-In-Part of Ser. No. 09/465,566 filed Dec. 17, 1999, U.S. Pat. No. 6,217,434 which is a Continuation of Ser. No. 09/054,948 filed Apr. 3, 1998 (now U.S. Pat. No. 6,022,268), which claims the benefit of U.S. Provisional Application No. 60/043,404 filed Apr. 4, 1997 and U.S. Provisional Application No. 60/049,440 filed Jun. 12, 1997.

BACKGROUND OF THE INVENTION

1. Field of the Invention

The present invention relates generally to polishing pads useful in the manufacture of semiconductor devices or the like. More particularly, the polishing pads of the present invention comprise an advantageous hydrophilic material having an innovative surface topography which generally improves predictability and polishing performance.

2. Discussion of the Related Art

Integrated circuit fabrication generally requires polishing of one or more substrates, such as silicon, silicon dioxide, tungsten or aluminum. Such polishing is generally accomplished, using a polishing pad in combination with a polishing fluid.

The semiconductor industry has a need for precision polishing to narrow tolerances, but unwanted "pad to pad" variations in polishing performance are quite common. A need therefore exists in the semiconductor industry for polishing pads which exhibit more predictable performance during high precision polishing operations.

SUMMARY OF INVENTION

The present invention is directed to thermoformed (or embossed) polishing pads having an innovative polishing surface formed from an innovative hydrophilic material. The pads of the present invention comprise a hydrophilic material having: i. a density greater than 0.5 g/cm$^3$; ii. a critical surface tension greater than or equal to 34 milliNewtons per meter; iii. a tensile modulus of 0.02 to 5 GigaPascals; iv. a ratio of tensile modulus at 30° C. to tensile modulus at 60° C. of 1.0 to 2.5; v. a hardness of 25 to 80 Shore D; vi. a yield stress of 300–6000 psi (2.1–41.4 MegaPascal); vii. a tensile strength of 1000 to 15,000 psi (7–105 MegaPascal); and viii. an elongation to break up to 500%. In a preferred embodiment, the polishing layer further comprises a plurality of soft domains and hard domains.

The polishing materials of the present invention do not include felt-based polishing pads created by coalescing a polymer onto a fiber substrate, as described in U.S. Pat. No. 4,927,432 to Budinger, et al.

The polishing surface has a topography produced by a thermoforming process. The topography consists of large and small features that facilitate the flow of polishing fluid and facilitate smoothing and planarizing.

DETAILED DESCRIPTION OF THE PREFERRED EMBODIMENTS

The present invention is directed to polishing pads formed from an innovative hydrophilic polishing material and having an innovative polishing surface. More specifically, the present invention is directed to an improved polishing pad useful in the polishing of substrates, particularly substrates for the manufacture of semiconductor devices or the like. The compositions and methods of the present invention may also be useful in other industries and can be applied to any one of a number of workpiece materials, including but not limited to silicon, silicon dioxide, metal, dielectrics, ceramics and glass. It should be noted that the term "polish" (and any form thereof) as used throughout this application, is intended to include "planarize" (and any corresponding forms).

The present invention is innovative because it; 1) recognizes the detrimental effect on precision polishing that occurs from damage caused by the incorporation of surface features into prior art pads; 2) recognizes how the damage is created during the fabrication of polishing pads; 3) teaches how to manufacture pads having low levels of damage; 4) teaches how to manufacture pads with highly reproducible surface features and therefore more predictable pad performance relative to conventional pads produced by cutting or skiving; and 5) teaches novel means to incorporate surface features into a pad during manufacture. None of these aspects of the present invention were heretofore appreciated in the art and are truly a significant contribution to the art of precision polishing. Some of the aspects of the present invention are described in U.S. Pat. No. 6,022,268 which is made a part of the present specification by reference.

The polishing pads of the present invention comprise a highly reproducible and advantageous surface topography with a minimum of surface damage such as indentations and protrusions often created during pad fabrication.

Pad fabrication that includes cutting or skiving creates damage that tends to vary from pad to pad. Prior art pad fabrication may include cutting sections of a polymer cake to form pads. As a blade cuts through the cake it typically leaves directional surface damage, including indentations and protrusions from the pad surface. The damage generally varies from pad to pad as the cutting edge dulls.

Another step in pad fabrication is the incorporation of channels or other features into the pad surface to facilitate polishing fluid flow. Prior art pads generally have these features cut or machined into the pad. This also generally, tends to leave damage on the pad surface and within the cuts. Other factors, such as temperature, humidity and line speed changes cause variations in the pad surface characteristics. These variations cause performance variations from pad to pad, making it difficult to delineate optimum polishing parameters.

The pads of the present invention are created with little or no cutting, machining or similar type fracturing of the polishing surface. Unwanted directional patterns such as those generated by skiving are generally eliminated. Surface features or a portion thereof are applied onto (or into) the pad, also without fracturing of the polishing surface. This eliminates the problems associated with prior art techniques.

According to the present invention, surface features incorporated after the formation of the pad are created, at least in part, by thermoforming. Thermoforming is any process whereby the surface of the pad is heated and is permanently deformed by some means such as pressure or stress. Thermoforming reduces the extent of damage relative to conventional pads. Thermoforming also provides more reproducible features than cutting or machining because of the consistency of the surface of the thermoforming die. Therefore, pads of the present invention exhibit more predictable performance and allow for optimum polishing parameters to be delineated.

In one embodiment, surface features are incorporated into the surface of the polishing pad, by heating the pad surface until it softens and then forming, or shaping it, utilizing a die and pressure. The features preferably comprise one or more indentations having an average depth and/or width of greater than about 0.05 millimeters and preferably greater than about 0.1 millimeters. These features facilitate the flow of polishing fluid and thereby enhance polishing performance.

In another embodiment pads are extruded to create a sheet of material. The material may be formed into a polishing belt by creating a seam from the two ends of the sheet, or in an alternative embodiment, the sheet may be cut to form pads of any shape or size. In another embodiment of the present invention, compression molding is employed whereby a pliable polymer is placed in a die. The polymer is then compressed which causes it to spread throughout the mold. It then solidifies and is released from the mold.

In another embodiment, the pad material is extruded upon a second solid or semi-solid material, thereby causing the extruded material to be bonded to the second material after it has solidified. The second material can provide reinforcement to the pad so that the solidified, extruded material need not be self-supporting. Alternatively or in addition, the second material can provide structural integrity to the pad, thereby providing improved performance, longevity and/or greater flexibility in manufacturing.

In a preferred embodiment of the present invention, surface features are embossed with a chilled roller employed to ensure that plastic flow subsequent to embossing is eliminated or significantly reduced. This creates very reproducible embossed indentations, generally reducing pad-to-pad variations typically found in pads produced by many conventional methods. This reproducibility is also a result of the embossing die surface remaining generally the same for each pad produced by it. This translates to more predictable pad performance. Predictability of performance is an important aspect of a precision polishing pad. Pad consistency allows for more exacting standard operating procedures and, therefore, more productive polishing operations. Furthermore, use of a roller to produce surface features allows pads to be manufactures in continuous sheets.

In addition to surface features traditionally cut or machined into a pad, smaller features (less than 50$\mu$) are necessary for optimum polishing performance. These small scale features are often incorporated prior to the first use of the pad and periodically during pad use. This is referred to as "conditioning". When conditioning is performed prior to use it is referred to as "preconditioning" and during use as reconditioning. During pad use the small scale features can experience unwanted plastic flow and can be fouled by debris. By conditioning, small scale features are regenerated. It has been surprisingly discovered that the polishing pads of the present invention generally require less reconditioning during use relative to conventional polishing pads. This is yet further evidence that the pads of the present invention are generally superior to conventional pads.

Pads of the present invention may be conditioned with an abrasive material. The small scale features may be created by moving the polishing surface against the surface of an abrasive material. In one embodiment, the abrasive material is a rotating structure (the abrasive material can be round, square, rectangular, oblong or of any geometric configuration) having a plurality of rigid particles embedded (and preferably, permanently affixed) upon the surface. The movement of the rigid particles against the pad surface causes the pad surface to undergo plastic flow, fragmentation or a combination thereof (at the point of contact with the particles). The abrasive surface need not rotate against the pad surface; the abrasive surface can move against the pad in any one of a number of ways, including vibration, linear movement, random orbitals, rolling or the like.

The resulting plastic flow, fragmentation or combination thereof (due to the abrasive surface), creates small scale features upon the pad's outer surface. The small scale features can comprise an indentation with a protrusion adjacent to at least one side. In one embodiment, the protrusions provide at least 0.1 percent of the surface area of the pad's polishing surface, and the indentations have an average depth of less than 50 microns, more preferably less than 10 microns, and the protrusions have an average height of less than 50 microns and more preferably less than 10 microns. Preferably, such surface modification with an abrasive surface will cause minimal abrasion removal of the polishing surface, but rather merely plows furrows into the pad without causing a substantial amount, if any, of pad material to separate from the polishing surface. However, although less preferred, abrasion removal of pad material is acceptable, so long as small scale features are produced.

The preferred abrasive surface for conditioning is a disk which is preferably metal and which is preferably embedded with diamonds of a size in the range of 1 micron to 0.5 millimeters. During conditioning, the pressure between the conditioning disk and the polishing pad is preferably between 0.1 and about 25 pounds per square inch. The disk's speed of rotation is preferably in the range of 1 to 1000 revolutions per minute.

A preferred conditioning disk is a four inch diameter, 100 grit diamond disk, such as the RESI™ Disk manufactured by R. E. Science, Inc. Optimum conditioning was attained when the downforce was 10 lb. per square inch, platen speed was 75 rpm, the sweep profile was bell-shaped, the number of conditioning sweeps prior to use was 15 and the number of re-conditioning sweeps between wafers was 15.

Optionally, conditioning can be conducted in the presence of a conditioning fluid, preferably a water based fluid containing abrasive particles.

According to the present invention, all or some of the small scale features may be created during a thermoforming process by use of an innovative thermoforming die. Through the selective release of the pad from the die by a differential affinity to the pad material, desired small scale features can be obtained.

According to the present invention, the thermoforming die has a differential affinity for the pad material. Portions of low affinity allow release of the pad with little or no disruption to the surface. Other portions of higher affinity inhibit release of the pad from the die, thereby causing plastic flow or fracturing of the surface in those areas. This process creates the desired small scale features. The differential affinity can be achieved by use of different materials, different die coatings or physical features of the die.

In one embodiment the thermoforming die is comprised of two or more materials having different affinities to the pad material. Upon release, portions of the pad surface adjacent to areas of high affinity are disrupted causing desirable surface features. In another embodiment, the die surface is coated to create areas of low and high affinity. In yet another embodiment, protrusions are incorporated into the die that have a shape that grabs the pad material in certain areas, causing creation of small scale features. In yet another embodiment, this grabbing effect is created by the protrusion material as opposed to the protrusion shape.

Formation of surface features during the fabrication of the pad can diminish or even negate the necessity for preconditioning. Such formation also provides more controlled and faithful replication of the small scale features as compared to surface modification by abrasive means.

Any prepolymer chemistry can be used in accordance with the present invention, including polymer systems other than urethanes, provided the final product exhibits the following properties: a density of greater than 0.5 g/cm$^3$, more preferably greater than 0.7 g/cm$^3$ and yet more preferably greater than about 0.9 g/cm$^3$; a critical surface tension greater than or equal to 34 milliNewtons per meter; a tensile modulus of 0.02 to 5 GigaPascals; a ratio of the tensile modulus at 30° C. to the modulus at 60° C. in the range of 1.0 to 2.5; hardness of 25 to 80 Shore D; a yield stress of 300 to 6000 psi; a tensile strength of 500 to 15,000 psi, and an elongation to break up to 500%. These properties are possible for a number of materials useful in extrusion and similar-type processes, such as: polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polyethylene imine, polyurethanes, polyether imide, polyketones, and the like, including photochemical reactive derivatives thereof.

In a preferred embodiment, the pad material is sufficiently hydrophilic to provide a critical surface tension greater than or equal to 34 milliNewtons per meter, more preferably greater than or equal to 37 milliNewtons per meter and most preferably greater than or equal to 40 milliNewtons per meter. Critical surface tension defines the wettability of a solid surface by noting the lowest surface tension a liquid can have and still exhibit a contact angle greater than zero degrees on that solid. Thus, polymers with higher critical surface tensions are more readily wet and are therefore more hydrophilic. Critical surface tension of common polymers are provided below:

| Polymer | Critical Surface Tension (mN/m) |
|---|---|
| Polytetrafluoroethylene | 19 |
| Polydimethylsiloxane | 24 |
| Silicone Rubber | 24 |
| Polybutadiene | 31 |
| Polyethylene | 31 |
| Polystyrene | 33 |
| Polypropylene | 34 |
| Polyester | 39–42 |
| Polyacrylamide | 35–40 |
| Polyvinyl alcohol | 37 |
| Polymethyl methacrylate | 39 |
| Polyvinyl chloride | 39 |
| Polysulfone | 41 |
| Nylon 6 | 42 |
| Polyurethane | 45 |
| Polycarbonate | 45 |

In one embodiment, the pad matrix is derived from at least:

1. an acrylated urethane;
2. an acrylated epoxy;
3. an ethylenically unsaturated organic compound having a carboxyl, benzyl, or amide functionality;
4. an aminoplast derivative having a pendant unsaturated carbonyl group;
5. an isocyanurate derivative having at least one pendant acrylate group;
6. a vinyl ether,
7. a urethane
8. a polyacrylamide
9. an ethylene/ester copolymer or an acid derivative thereof;
10. a polyvinyl alcohol;
11. a polyrnethyl methacrylate;
12. a polysulfone;
13. an polyamide;
14. a polycarbonate;
15. a polyvinyl chloride;
16. an epoxy;
17. a copolymer of the above; or
18. a combination thereof.

Preferred pad materials comprise urethane, carbonate, amide, sulfone, vinyl chloride, acrylate, methacrylate, vinyl alcohol, ester or acrylamide moieties. The pad material can be porous or non-porous. In one embodiment, the matrix is non-porous; in another embodiment, the matrix is non-porous and free of fiber reinforcement. The pad material may also contain abrasives.

In a preferred embodiment, the polishing material comprises: 1. a plurality of rigid domains which resists plastic flow during polishing; and 2. a plurality of less rigid domains which is less resistant to plastic flow during polishing. This combination of properties provides a dual mechanism which has been found to be particularly advantageous in the polishing of silicon dioxide, dielectric materials and metal.

The rigid phase size in any dimension (height, width or length) is preferably less than 100 microns, more preferably less than 50 microns, yet more preferably less than 25 microns and most preferably less than 10 microns. Similarly the non-rigid phase is also preferably less than 100 microns, more preferably less than 50 microns, more preferably less than 25 microns and most preferably less than 10 microns. Preferred dual phase materials include polyurethane polymers having a soft segment (which provides the non-rigid phase) and a hard segment (which provides the rigid phase). The domains are produced as the material is formed by a phase separation, due to incompatibility between the two (hard and soft) polymer segments.

Other polymers having hard and soft segments could also be appropriate, including ethylene copolymers, copolyester, block copolymers, polysulfones copolymers and acrylic copolymers. Hard and soft domains within the pad material can also be created: 1. by hard and soft segments along a polymer backbone; 2. by crystalline regions and non-crystalline regions within the pad material; 3. by alloying a hard polymer with a soft polymer; or 4. by combining a polymer with an organic or inorganic filler.

The polishing materials of the present invention do not include felt-based polishing pads created by coalescing a polymer onto a fiber substrate, as described in U.S. Pat. No. 4,927,432 to Budinger, et al.

The pads of the present invention are preferably used in combination with a polishing fluid, which may include abrasive particles. During polishing, the polishing fluid is placed between the pad's polishing surface and the workpiece to be polished. As the relative position between the pad and substrate change, the surface features allow for improved polishing fluid flow along the interface between the pad and the substrate to be polished and facilitate smoothing and planarizing. The improved flow of polishing fluid and interaction between the pad and workpiece generally allows for more efficient and effective polishing performance.

In use, the pads of the present invention are preferably attached to a platen and then brought sufficiently proximate with a workpiece to be polished. Surface irregularities are removed from the workpiece at a rate which is dependent upon a number of parameters, including: pad pressure on the workpiece surface (or vice versa); the speed at which the pad and workpiece move in relation to one another; and the components of the polishing fluid. Generally, the pressure between the workpiece and the polishing pad surface is greater than 0.1 kilograms per square meter.

The polishing fluid is preferably water based and may or may not require the presence of abrasive particles, depending upon the composition of the pad material. For example, a material comprising abrasive particles may not require abrasive particles in the polishing fluid.

The following Examples show the utility of polishing pads wherein the polishing surfaces are embossed.

EXAMPLE 1

This example illustrates the utility of an embossed pad of low hardness for polishing a soft metal such as aluminum.

A thermoplastic polyurethane (MP-1880 from J. P. Stevens) of hardness 85 Shore A was extruded at temperature into a 25 mil sheet of material. This sheet was then subsequently embossed at elevated temperature with a hexagonal pattern such that the surface of the sheet consisted of raised hexagonal areas. In order to facilitate slurry flow across the surface each hexagonal area also contained finer grooves. The hexagonal areas were approximately 5 mm across and separated by 0.5 mm channels.

The embossed sheet of polyurethane was laminated to pressure sensitive adhesive and cut into a circle shape, thus enabling it to be used as a polishing pad. The resulting pad was used for aluminum CMP polishing on a Westech 372U polisher. Using typical polishing conditions of downforce, carrier and platen speeds, removal rates of aluminum and oxide were 2280 and 70 A/min, giving an Al:Ox selectivity of 32:1.

EXAMPLE 2

This example illustrates the utility of an embossed pad of high hardness for polishing an oxide inner-layer dielectric.

A thermoplastic polyurethane (Texin 470D from Miles Inc.) of hardness 70 Shore D was extruded at temperature into a 50 mil sheet of material. This sheet was then subsequently embossed at elevated temperature using a similar pattern to that described in Example 1.

The embossed sheet of polyurethane was laminated to pressure sensitive adhesive and cut into a circle shape, thus enabling it to be used as a polishing pad. The resulting pad, in conjunction with ILD1300 slurry (made by Rodel Inc.), was used for Thermal Oxide CMP polishing on a Westech 372U polisher. Using typical polishing conditions of downforce, carrier and platen speeds, oxide removal rate was greater than 2000 A/min and non-uniformity across the wafer less than 10%.

The preceding description and examples are not meant to be restrictive in any way. The scope of this invention is to be determined solely from the claims.

What is claimed is:

1. A polishing pad, which is not a felt-based polishing pad created by coalescing a polymer onto a fiber substrate, comprising:

a thermoplastic hydrophilic material having:

i. a density greater than 0.5 g/cm$^3$;

ii. a critical surface tension greater than or equal to 34 milliNewtons per meter;

iii. a tensile modulus of 0.02 to 5 GigaPascals;

iv. a ratio of tensile modulus at 30° C. to tensile modulus at 60° C. of 1.0 to 2.5;

v. a hardness of 25 to 80 Shore D;

vi. a yield stress of 300–6000 psi;

vii. a tensile strength of 1000 to 15,000 psi; and viii. an elongation to break less than or equal to 500%, said thermoplastic hydrophilic material having a polishing surface, said surface having a plurality of features produced by a thermoforming process, said features having at least one dimension of greater than 0.01 millimeters, facilitating the flow of a polishing fluid, and facilitating chemical-mechanical polishing of a semiconductor device or a precursor to a semiconductor device; and said pad being formed as a sheet by an extrusion process.

2. A pad in accordance with claim 1, wherein said thermoplastic hydrophilic material further comprises at least one moiety from the group consisting of: 1. a urethane; 2. a carbonate; 3. an amide; 4. an ester; 5. an ether; 6. an acrylate; 7. a methacrylate; 8. an acrylic acid; 9. a methacrylic acid; 10. a sulphone; 11. an acrylamide; 12. a halide; and 13. a hydroxide.

3. A pad in accordance with claim 1, wherein said thermoplastic hydrophilic material further comprises a plurality of soft domains and a plurality of hard domains, said hard domains and said soft domains having an average size of less than 100$\mu$.

4. A pad in accordance with claim 3, wherein said hard domains and said soft domains are produced by a phase separation as said thermoplastic hydrophilic material is formed, said thermoplastic hydrophilic material comprising a polymer having a plurality of hard segments and a plurality of soft segments.

5. A pad in accordance with claim 1, wherein said thermoplastic hydrophilic material consists essentially of a two phase polyurethane.

6. A pad in accordance with claim 1, wherein said thermoplastic hydrophilic material further comprises abrasive particles.

7. A pad in accordance with claim 1, wherein said thermoplastic hydrophilic material consists essentially of a material selected from the group consisting of: polymethyl methacrylate, polyvinyl chloride, polysulfone, nylon, polycarbonate polyurethane, ethylene copolymer, polyether imide, polyethylene imine, polyketone and combinations thereof.

8. A pad as in claim 1 wherein said sheet has a beginning edge and ending edge, the edges being joined to form a continuous belt.

9. A pad as in claim 1 wherein said sheet is cut to form pads of any size or shape.

10. A pad as in claim 1 wherein the thermoforming is an embossing process.

11. A pad in accordance with claim 10 wherein the surface is softened by an increase in temperature allowing the features to be embossed by pressure exerted by an embossing roller cooled to a temperature allowing the polishing material to hold the embossed pattern.

12. A pad as in claim 1 wherein a thermoforming die is used to produce the features, the features including small scale features, having a height, width or depth no greater than 25$\mu$, the thermoforming die having portions of low affinity to the pad material and high affinity to the pad material thereby being capable of selectively releasing portions of the pad to produce all or some of the small scale features.

13. A pad as in claim 1 wherein a thermoforming die is used to produce the features, the features including small scale features, having a height, width or depth no greater than 25$\mu$, the thermoforming die having protrusions having a shape which when surrounded by the pad material inhibits release of the material thereby being capable of selectively releasing portions of the pad to produce all or some of the small scale features.

14. A pad as in claim 1 wherein a thermoforming die is used to produce the features, the features including small scale features, having a height, width or depth no greater than 25$\mu$, the thermoforming die having protrusions comprised of a material having a greater affinity to the pad material thereby being capable of selectively releasing portions of the pad to produce all or some of the small scale features.

15. A polishing pad, which is not a felt-based polishing pad created by coalescing a polymer onto a fiber substrate, comprising:

a thermoplastic material having:

i. a density greater than 0.5 g/cm$^3$;

ii. a critical surface tension greater than or equal to 34 milliNewtons per meter;

iii. a tensile modulus of 0.02 to 5 GigaPascals;

iv. a ratio of tensile modulus at 30° C. to tensile modulus at 60° C. of 1.0 to 2.5;

v. a hardness of 25 to 80 Shore D;

vi. a yield stress of 300—6000 psi;

vii. a tensile strength of 1000 to 15,000 psi; and viii. an elongation to break less than or equal to 500%, said thermoplastic material having a polishing surface, said surface having a plurality of features produced by a thermoforming process, said features having at least one dimension of greater than 0.01 millimeters, facilitating the flow of a polishing fluid, and facilitating chemical-mechanical polishing of a semiconductor device or a precursor to a semiconductor device; and said pad being formed as a sheet by an extrusion process.

16. A pad in accordance with claim 15, wherein said thermoplastic material further comprises at least one moiety from the group consisting of: 1. a urethane; 2. a carbonate; 3. an amide; 4. an ester; 5. an ether; 6. an acrylate; 7. a methacrylate; 8. an acrylic acid; 9. a methacrylic acid; 10. a sulphone; 11. an acrylamide; 12. a halide; and 13. a hydroxide.

17. A pad in accordance with claim 15, wherein said thermoplastic material further comprises a plurality of soft domains and a plurality of hard domains, said hard domains and said soft domains having an average size of less than 100$\mu$.

18. A pad in accordance with claim 17, wherein said hard domains and said soft domains are produced by a phase separation as said thermoplastic material is formed, said thermoplastic material comprising a polymer having a plurality of hard segments and a plurality of soft segments.

19. A pad in accordance with claim 15, wherein said thermoplastic material consists essentially of a two phase polyurethane.

20. A pad in accordance with claim 15, wherein said thermoplastic material further comprises abrasive particles.

21. A pad in accordance with claim 15, wherein said thermoplastic material consists essentially of a material selected from the group consisting of: polymethyl methacrylate, polyvinyl chloride, polysulfone, nylon, polycarbonate polyurethane, ethylene copolymer, polyether imide, polyethylene imine, polyketone and combinations thereof.

22. A pad as in claim 15 wherein said sheet has a beginning edge and ending edge, the edges being joined to form a continuous belt.

23. A pad as in claim 15 wherein said sheet is cut to form pads of any size or shape.

24. A pad as in claim 15 wherein the thermoforming is an embossing process.

25. A pad in accordance with claim 24 wherein the surface is softened by an increase in temperature allowing the features to be embossed by pressure exerted by an embossing roller cooled to a temperature allowing the polishing material to hold the embossed pattern.

26. A pad as in claim 15 wherein a thermoforming die is used to produce the features, the features including small scale features, having a height, width or depth no greater than 25$\mu$, the thermoforming die having portions of low affinity to the pad material and high affinity to the pad material thereby being capable of selectively releasing portions of the pad to produce all or some of the small scale features.

27. A pad as in claim 15 wherein a thermoforming die is used to produce the features, the features including small scale features, having a height, width or depth no greater than 25$\mu$, the thermoforming die having protrusions having a shape which when surrounded by the pad material inhibits release of the material thereby being capable of selectively releasing portions of the pad to produce all or some of the small scale features.

28. A pad as in claim 15 wherein a thermoforming die is used to produce the features, the features including small scale features, having a height, width or depth no greater than 25$\mu$, the thermoforming die having protrusions comprised of a material having a greater affinity to the pad material thereby being capable of selectively releasing portions of the pad to produce all or some of the small scale features.

* * * * *